US005599260A

United States Patent [19]

Rovinsky et al.

[11] Patent Number: 5,599,260

[45] Date of Patent: Feb. 4, 1997

[54] DEVICE FOR EXERCISING DURING OFFICE WORK

[76] Inventors: William Rovinsky, 212 Heypath Rd., Bethpage, N.Y. 11804; Ilya Zborovsky, 6 Schoolhouse Way, Dix Hills, N.Y. 11746

[21] Appl. No.: 273,203

[22] Filed: Jul. 11, 1994

[51] Int. Cl.[6] ..... A63B 21/02

[52] U.S. Cl. ..... 482/121; 482/129; 482/124

[58] Field of Search ..... 482/121, 130, 482/129, 124, 126, 132; 280/109, 116

[56] References Cited

U.S. PATENT DOCUMENTS 1,902,694 3/1933 Edwards ..... 482/130

3,421,760 1/1969 Freeman, Jr. ..... 482/130

4,852,873 8/1989 O'Donnell et al. ..... 482/126

*Primary Examiner*—Jerome Donnelly

*Attorney, Agent, or Firm*—Ilya Zborovsky

[57] ABSTRACT

An exercising device for exercising while doing office work has an exercising element for exercising a part of a user's body while a user works at an article of office furniture, and an element for connecting the exercising element with the article of the office furniture so that the user can do office work at the article of furniture and simultaneously exercise the part of his body with the exercising element.

1 Claim, 2 Drawing Sheets

FIG. 1
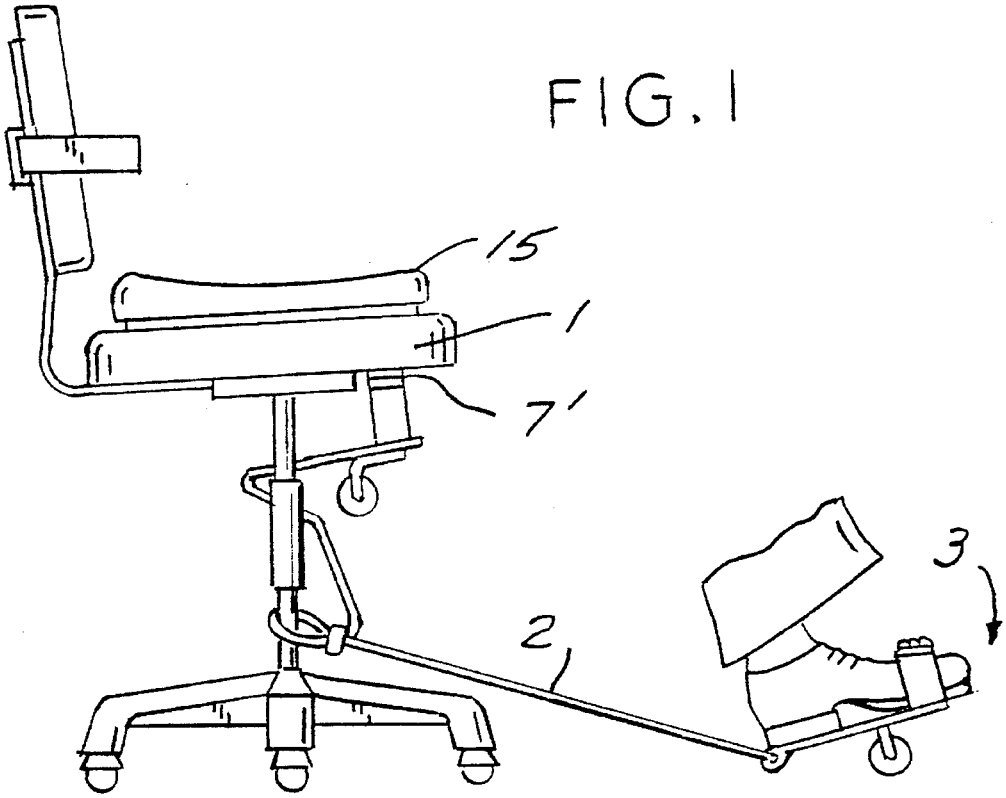
FIG. 2
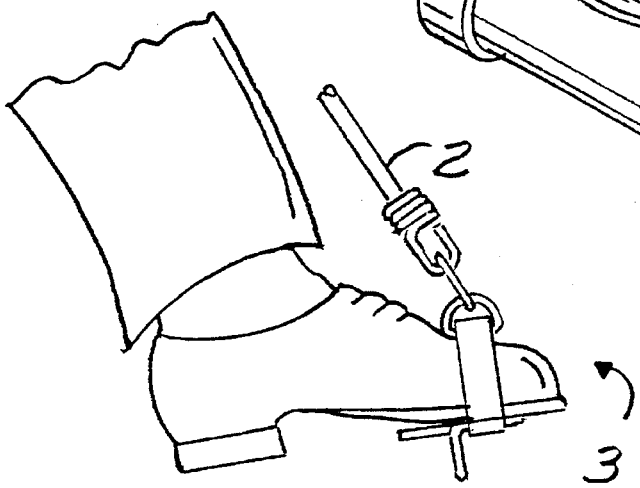
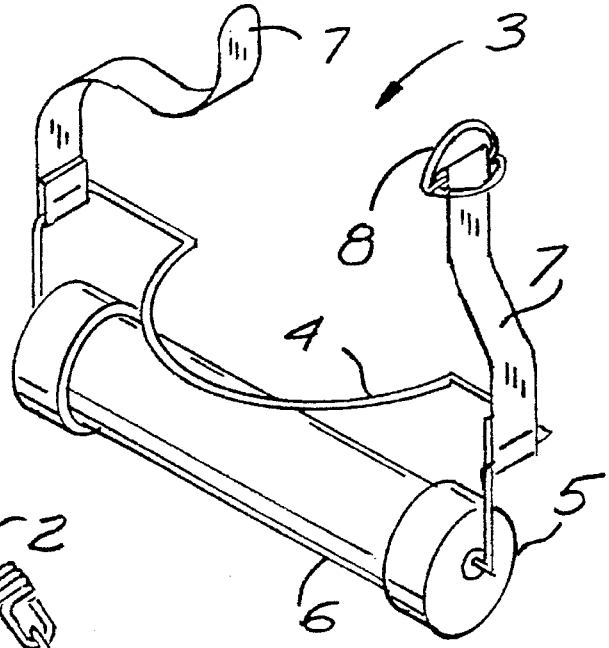
FIG. 3

FIG. 4
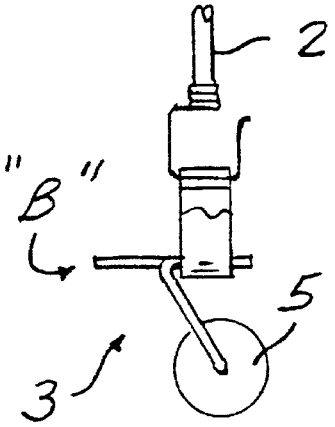
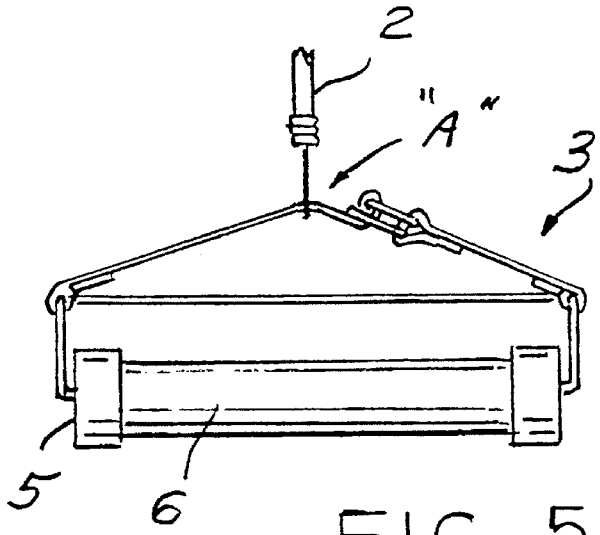
FIG. 5
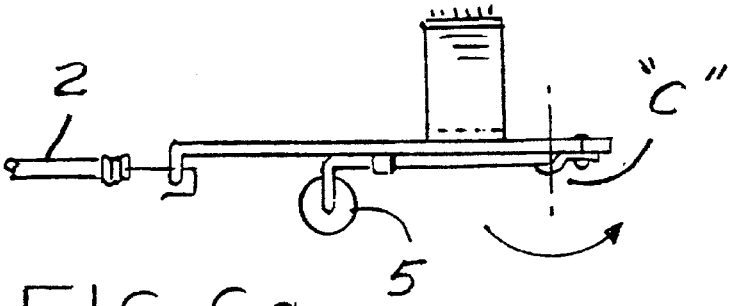
FIG. 6a
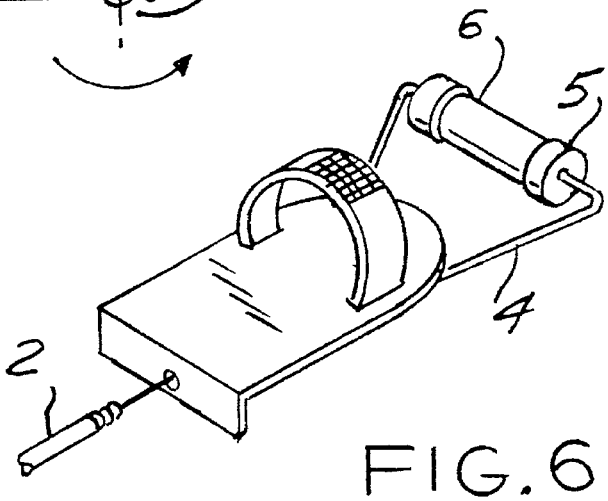
FIG. 6
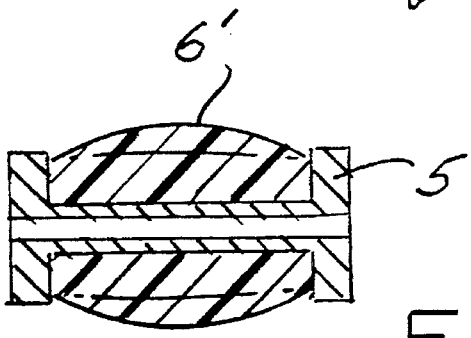
FIG. 7

DEVICE FOR EXERCISING DURING OFFICE WORK

BACKGROUND OF THE INVENTION

The present invention relates to a device for exercising during an office work.

Many exercising devices have been developed and used for exercising in special places such as health spas, gyms and the like, and also for exercising in the privacy of user's home. It is however well known that people who work in offices and sit the whole day before their office desks are usually tired after short periods of time of their working day since they do not sufficiently move during working hours. They experience certain discomfort in various parts of their body and their productivity substantially reduces. Months and years of office work lead to the developments of permanent deficiencies in a worker's body and in many instances result in serious sicknesses. Exercising before work and after work is helpful in alleviating unpleasant feelings connected with lack of movement during work and relieving of stresses. However, during the long periods of doing work in the office no attempts have been made doing an office work with simultaneous working out.

SUMMARY OF THE INVENTION

Accordingly, it is an object of the present invention to provide a device for exercising during doing office work.

In keeping with these objects and with others which will become apparent hereinafter, one feature of the present invention resides, briefly stated, in an exercising device, comprising an exercising element formed so that a user can exercise a part of his body and means for connecting the exercising element to an article of office furniture, so that a user during doing office work and using the article of office furniture can simultaneously exercise a part of his body.

When the device is designed in accordance with the present invention, it permits combining office work with simultaneous working out.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing a new exercising device attached to an office chair;

FIG. 2 is a view showing an exercising element of the exercising device when used by a user's leg;

FIG. 3 is a view showing a detail of the exercising element of FIG. 2 on an enlarged scale;

FIGS. 4 and 5 are a side view and a front view of the exercising element;

FIG. 6 is a view showing the exercising element in a position for exercising user's hands; and FIG. 7 is a view showing a modification of a part of the exercising element;

DESCRIPTION OF THE PREFERRED EMBODIMENTS

An exercising device for exercising legs and hands in FIG. 1 is attachable to a vertical support of an office chair 1. The device has an elastic stretchable element 2 which can be simply attached to the vertical support by winding it around the support and tying the loose end, or by any other known means. A distal end of the stretchable element 2 is connected with an exercising element which is identified as a whole with reference numeral 3. The exercising element includes a supporting metal piece 4 formed for example as a rigid wire, and a roller 5 which is rotatably supported on two ends of the wire. An elastic layer 6 is applied on the central portion of the roller 5 and in FIG. 3 has a diameter which is smaller than the diameter of the roller 5. It is believed that the roller 5 has a central part of a smaller diameter on which the elastic layer 6 is applied and two side parts of greater diameter. Two belt pieces 7 and 8 are connected to the sides of the wire 4, and one of them is provided with a buckle 8. The elastic element 2 is connected either to the wire 4 in the point B when the exercising is attached to the office chair, or is connected to the buckle 8 with the exercising device is attached to an office desk as will be described hereinbelow. For this purpose point B can be also provided with a buckle 8, and the distal end of the elastic element 2 can be provided with a hook similar to the hook shown in FIG. 4 and engageable with the buckle 8.

In order to exercise legs, the elastic element 2 is attached to the vertical support of the chair 1, and the user places his foot onto the wire 4 and buckles it by the adjustable belt 7, 8. By rolling the roller 5 with the foot back and forth and thereby stretching and releasing of the elastic element 2, the user exercises his leg. The chair can be provided with only one device so that the user can alternatingly exercise his left or right leg or with two devices so that the user can exercise his two legs simultaneously.

FIGS. 6 and 6*a* show a further modification of the exerciser of the embodiment of FIG. 4. In this embodiment the roller is turnable together with the wire from the position shown in FIG. 6*a* to the position shown in FIG. 6. This is done for folding and unfolding the roller, which is unfolded in position of FIG. 6. In this position it is easier to take the roller in the user's arm and exercise the arm by compressing and releasing the elastic layer 6 of the roller 5. While in the roller of FIG. 3 the elastic layer 6 has a smaller outer diameter than the roller 5, in the embodiment shown in FIG. 7 the elastic layer 6' has a greater diameter than the roller 5. With this construction when the user exercises his legs he additionally presses on the elastic layer 6' to compress and to release it, and provides for additional exercise of his foot.

As can be seen in FIG. 1 means are provided for transferring the exercising device from the working position to a storing position. For this purpose any part of the exercising device can be provided with a piece of a velcro connection 7' (for example with projecting hooks), while another piece of the velcro connection can be attached to a lower surface of the chair (for example provided with loops) for transferring the exercising device to the storing position the velcro piece attached to the exercising device is connected to the velcro piece attached to the chair and the exercising device is reliably secured to the chair so as not to interfere with the user's movements.

It will be understood that each of the elements described above, or two or more together, may also find a useful application in other types of constructions differing from the types described above.

While the invention has been illustrated and described as embodied in a device for exercising during office work, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An exercising machine for exercising while doing office work, comprising an exercising element for exercising a part of a user's body while the user works at an article of office furniture; and means for connecting said exercising element with the article of furniture thereby allowing the user to do office work at the article of furniture and simultaneously exercise the part of his or her body with said exercising element, said connecting means including an elastic element having one end connectable with the article of furniture and another end connected with said exercising element, said exercising element including an elongated roller means connected with said elastic element, said elongated roller means being rollable with a user's foot along a ground surface and also being moveable with a user's hand to pull said elastic element and to thereby stretch said elastic element, said exercising element having a support for supporting a user's foot and connected with said elongated roller means, said support has a working position extending horizontally rearwardly beyond a central axis of rotation of said elongated roller means and has a rearward point which it is connected with said elastic element, said exercising element also having means for fastening a user's foot on said support, said support being pivotal between a position in which it extends substantially vertically from said elongated roller means in a working position extending horizontally rearwardly beyond a central axis of rotation of said elongated roller means for placing a user's foot on said support, and another position in which it extends substantially horizontally relative to said elongated roller means when said elongated roller means is used for exercising a user's arms; and means for allowing pivoting of said support between said positons.

* * * * *